US012055012B1

(12) United States Patent
Elkhalil et al.

(10) Patent No.: US 12,055,012 B1
(45) Date of Patent: Aug. 6, 2024

(54) CASING STRING FOR USE IN EXTENDED REACH WELLBORES

(71) Applicant: FORUM US, INC., Houston, TX (US)

(72) Inventors: Samer Elkhalil, Houston, TX (US); Jeffery Morrison, Missouri City, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 18/113,142

(22) Filed: Feb. 23, 2023

(51) Int. Cl.
*E21B 34/06* (2006.01)
*E21B 33/12* (2006.01)
*E21B 43/26* (2006.01)

(52) U.S. Cl.
CPC ..... *E21B 34/063* (2013.01); *E21B 33/12* (2013.01); *E21B 43/261* (2013.01); *E21B 2200/08* (2020.05)

(58) Field of Classification Search
CPC ..... E21B 34/063; E21B 33/12; E21B 43/261; E21B 2200/08
See application file for complete search history.

(56) References Cited

U.S. PATENT DOCUMENTS 4,031,960 A * 6/1977 Dudley ..... E21B 34/063 137/71
4,469,174 A * 9/1984 Freeman ..... E21B 17/14 166/317
6,622,798 B1 9/2003 Rogers et al.
10,156,118 B2 12/2018 Fripp et al.
10,465,445 B2 * 11/2019 Getzlaf ..... E21B 21/10
10,465,468 B2 11/2019 Frazier et al.
2015/0068730 A1 * 3/2015 Frazier ..... E21B 34/063 166/181
2019/0352295 A1 11/2019 Osborne et al.
2019/0352995 A1 * 11/2019 Giroux ..... E21B 47/06
2021/0254430 A1 8/2021 Yuan et al.
2021/0363858 A1 11/2021 Yuan et al.
2022/0228461 A1 * 7/2022 Sims ..... E21B 34/063
2022/0282581 A1 9/2022 Zakharia

FOREIGN PATENT DOCUMENTS

CA 3113269 A1 * 2/2022 ..... E21B 34/063
WO 2021040759 A1 3/2021

OTHER PUBLICATIONS

Forum Energy Technologies, Inc. | Davis-Lynch—"CleanBore Buoyancy Sub" datasheet, Mar. 2021, 1 page.
Forum Energy Technologies, Inc. | Davis-Lynch—"Vanishing Port Toe Sleeve" datasheet, May 2022, 1 page.
International Search Report and Written Opinion for International Application No. PCT/US2024/016653 Mailed Apr. 23, 2024.

* cited by examiner

*Primary Examiner* — James G Sayre
(74) *Attorney, Agent, or Firm* — Patterson + Sheridan, LLP

(57) ABSTRACT

Aspects of the present disclosure relate to a casing string comprising a buoyant mandrel and one or more dissolvable plugs, and methods of conducting wellbore operations using the casing string. The casing string may have an upper mandrel comprising a rupture disk. A slotted mandrel may be coupled to a lower end of the upper mandrel and comprise a plug disposed in a port of the slotted mandrel. A casing shoe may be coupled to a lower end of the slotted mandrel and comprise a check valve assembly. A gas filled chamber may be formed between the rupture disk and the check valve assembly. The plug may be configured to dissolve after a predetermined amount of time when in contact with a wellbore fluid.

22 Claims, 5 Drawing Sheets

CASING STRING FOR USE IN EXTENDED REACH WELLBORES

BACKGROUND

Field

Aspects of the present disclosure relate to casing strings for use in extended reach wellbores.

Description of the Related Art

Once a wellbore has been drilled, additional steps must be taken to complete the wellbore. For example, a casing string comprising one or more tubular members coupled together is lowered and cemented into the wellbore. Oftentimes lowering the casing string into a long lateral (e.g. horizontal) section of the wellbore is challenging because of excessive drag forces placed on the casing string. The excessive drag forces, which may cause buckling of the casing string, are due to the weight of the casing string and the contact with the wellbore as the casing string is being moved through the long lateral section of the wellbore. In addition, once the wellbore is complete, operators are continuously looking for ways to increase wellbore production.

Therefore, there is a need for new and/or improved apparatus and methods for completing wellbores and increasing wellbore production.

SUMMARY

In one embodiment, a casing string comprises an upper mandrel comprising a rupture disk; a slotted mandrel coupled to a lower end of the upper mandrel and comprising a plug disposed in a port of the slotted mandrel; and a casing shoe coupled to a lower end of the slotted mandrel and comprising a check valve assembly, wherein a gas filled chamber is formed between the rupture disk and the check valve assembly, and wherein the plug is configured to dissolve to allow fluid flow through the port after a predetermined amount of time when in contact with a wellbore fluid.

In one embodiment, a method of conducting a wellbore operation comprises lowering a casing string into an angled or horizontal section of a wellbore. The casing string may comprise a dissolvable plug, a rupture disk, a check valve assembly, and a gas filled chamber formed between the rupture disk and the check valve assembly. The gas filled chamber may create a buoyant force on the casing string when lowered into the angled or horizontal section of the wellbore. A protective coating may be applied to a portion of the dissolvable plug. The method may further comprise rupturing the rupture disk; pumping fluid through the check valve assembly of the casing string to force gas from the gas filled chamber out of the casing string, wherein the fluid contacts a portion of the dissolvable plug that does not have the protective coating and begins to dissolve the dissolvable plug; and when the dissolvable plug dissolves, pumping fluid from the wellbore back into the casing string through a port that was sealed by the dissolvable plug.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as subs, mandrels, links, etc.

Figure 1:
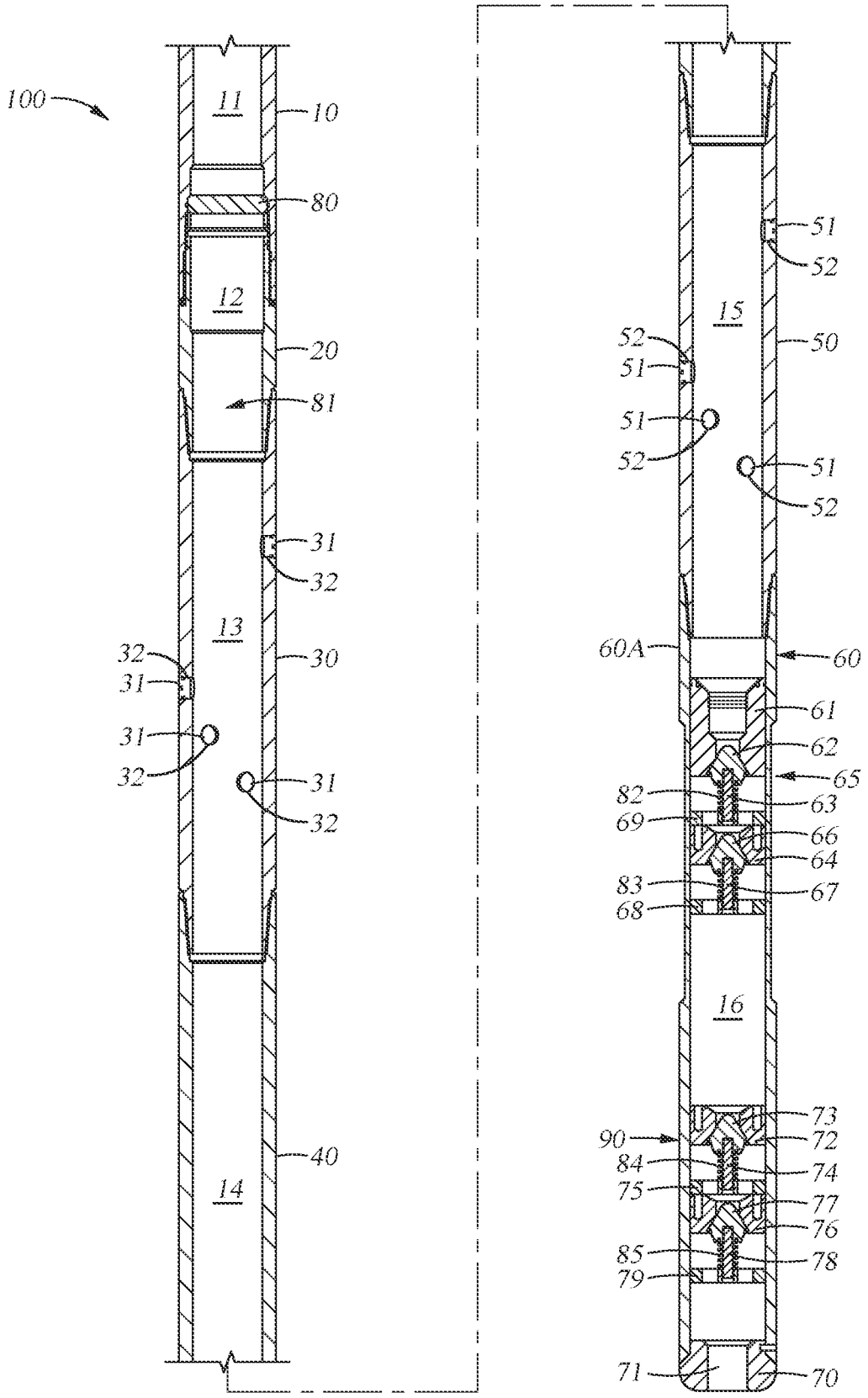
FIG. 1 is a sectional view of a casing string, according to one embodiment.

FIG. 1 is a sectional view of a casing string 100, according to one embodiment. The casing string 100 is in the form of one or more tubular members, referred to herein as mandrels, which are coupled together. The casing string 100 comprises an upper mandrel 10, a first coupling mandrel 20, a first slotted mandrel 30, a second coupling mandrel 40, a second slotted mandrel 50, and a casing shoe 60. An upper end of the upper mandrel 10 may be coupled to one or more mandrels that extend to the surface when the casing string 100 is lowered into a wellbore. Although two coupling mandrels 20, 40 and two slotted mandrels 30, 50 are shown, only one coupling mandrel and one slotted mandrel can be used to form the casing string 100. Alternatively, three, four, five, six, or more coupling mandrels and slotted mandrels can be used to form the casing string 100. In addition, any one or more of the mandrels 10, 20, 30, 40, 50 and/or the casing shoe 60 can be integrally formed as a single mandrel.

The upper mandrel 10 has an outer surface and an inner surface that forms an inner bore 11. The first coupling mandrel 20 has an outer surface and an inner surface that forms an inner bore 12. The first slotted mandrel 30 has an outer surface and an inner surface that forms an inner bore 13. The second coupling mandrel 40 has an outer surface and an inner surface that forms an inner bore 14. The second slotted mandrel 50 has an outer surface and an inner surface that forms an inner bore 15. The casing shoe 60 has an outer surface and an inner surface that forms an inner bore 16. Collectively, the inner bores 11, 12, 13, 14, 15, and 16 form a casing string inner bore 81 through which fluid can flow.

A rupture disk 80, such as a glass disk, is coupled to the upper mandrel 10 and is disposed in the bore 11 of the upper mandrel 10. The rupture disk 80 is configured to form an atmospheric chamber within the portion of the casing string inner bore 81 below the rupture disk 80 and above the casing shoe 60. The rupture disk 80 temporarily creates a seal within the casing string inner bore 81 so that the portion of the casing string 100 below the rupture disk 80 can be filled with a gas (e.g. air) and the portion of the casing string 100 above the rupture disk 80 can be filled with drilling fluid (e.g. a liquid). Although only one rupture disk 80 is shown, two or more rupture disks 80 can be coupled to and disposed in the upper mandrel 10.

A lower end of the upper mandrel 10 may be coupled to an upper end of the first coupling mandrel 20. A lower end of the first coupling mandrel 20 may be coupled to an upper end of the first slotted mandrel 30. A lower end of the first slotted mandrel 30 may be coupled to an upper end of the second coupling mandrel 40. A lower end of the second coupling mandrel 40 may be coupled to an upper end of the second slotted mandrel 50. A lower end of the second slotted mandrel 50 may be coupled to an upper end of the casing shoe 60.

The first slotted mandrel 30 comprises one or more plugs 31 disposed in corresponding ports 32 formed through the body of the first slotted mandrel 30. Although only four plugs 31 and ports 32 are illustrated in FIG. 1, the first slotted mandrel 30 may comprise any number of plugs and ports arranged at any location along and about the first slotted mandrel 30. The plugs 31 may be formed out of a dissolvable material that is configured to dissolve after a predetermined amount of time when exposed to a fluid, such as a liquid.

Figure 5:
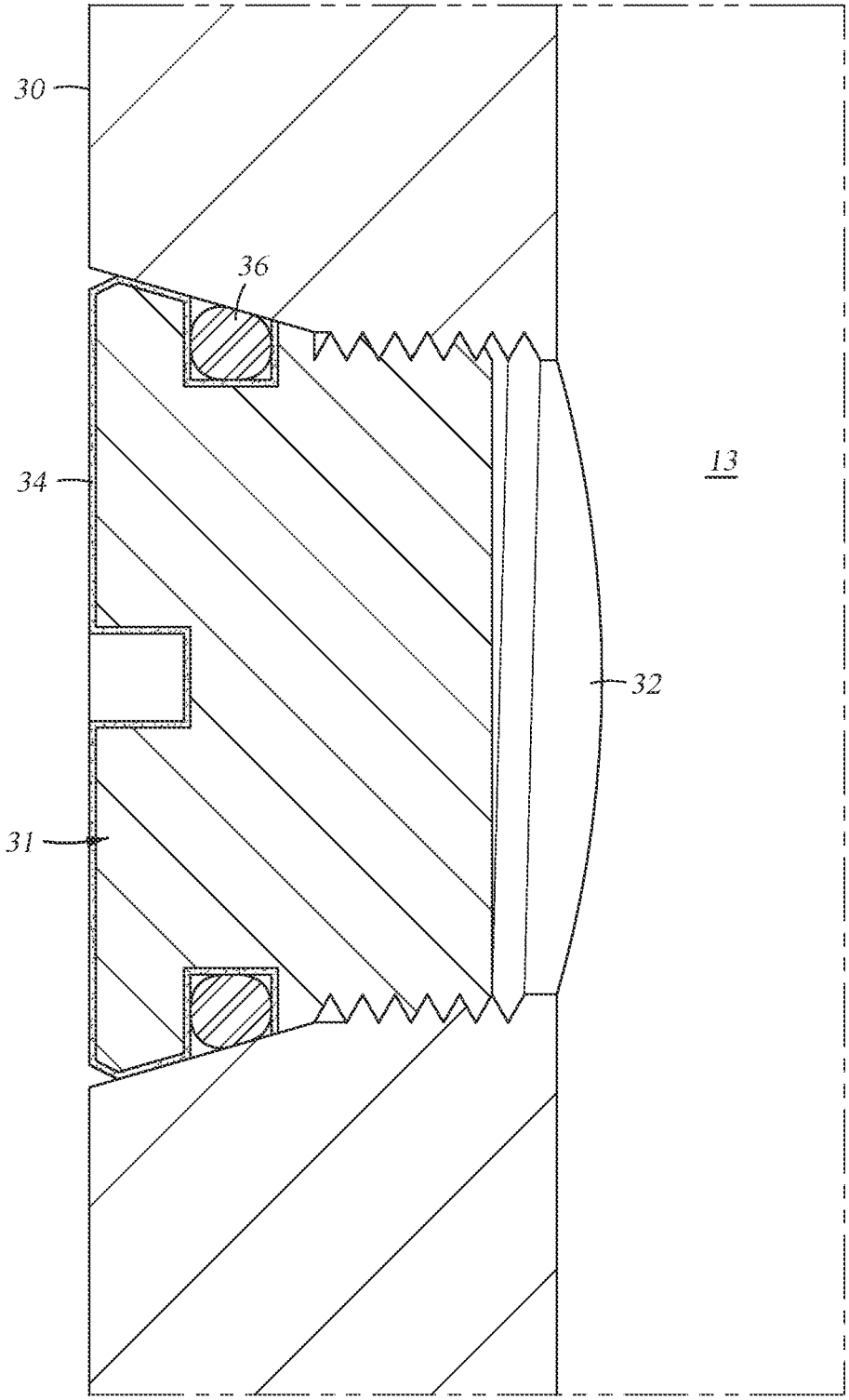
FIG. 5 is an enlarged sectional view of a plug, according to one embodiment.

FIG. 5 illustrates an enlarged sectional view of a plug 31 disposed in a port 32 formed through the body of the first slotted mandrel 30, according to one embodiment. For example, the plug 31 may be press fit or threaded into the port 32. A seal 36, such as an O-ring, is disposed between the outer diameter of the plug 31 and the inner diameter of the port 32. A portion of the plug 31 is covered with a coating, and a portion of the plug 31 is not covered with the coating. Specifically, a coating 34 is disposed on at least a portion of the outer diameter of the plug 31, and on the upper (or outer) surface of the plug 31, which is the surface closest to the outer diameter of the first slotted mandrel 30. The lower (or inner) surface of the plug 31, which is the surface closest to the inner diameter of the first slotted mandrel 30 and exposed to the inner bore 13 of the first slotted mandrel 30, does not include any coating 34. The coating 34 prevents the outer diameter and the upper surfaces of the plug 31 from dissolving when exposed to wellbore fluids. As further described below, a wellbore fluid pumped into the inner bore 13 of the first slotted mandrel 30 contacts the lower surface, e.g. the uncoated surface or portion, of the plug 31 and begins to dissolve the plug 31 to open fluid flow through the port 32.

Referring back to FIG. 1, the second slotted mandrel 50 comprises one or more plugs 51 disposed in corresponding ports 52 formed through the body of the second slotted mandrel 50. Although only four plugs 51 and ports 52 are illustrated in FIG. 1, the second slotted mandrel 50 may comprise any number of plugs and ports arranged at any location along and about the second slotted mandrel 50. The plugs 51 may be formed out of a dissolvable material that is configured to dissolve after a predetermined amount of time when exposed to a fluid, such as a liquid. The description and illustration of the plug 31 described herein with respect to FIG. 5 similarly applies to the plugs 51.

The casing shoe 60, also referred to as a wet shoe or a float shoe, is coupled to the lower end of the casing string 100. An end cap 70 having an inner bore 71 is coupled the lower end of the casing shoe 60. Fluid can flow into and out of the casing string 100 through the inner bore 71 of the end cap 70.

The casing shoe 60 comprises a tubular mandrel 60A forming the inner bore 16, and an upper check valve assembly 65 and a lower check valve assembly 90 coupled to the tubular mandrel 60A and disposed in the inner bore 16. The upper and lower check valve assemblies 65, 90 comprise one or more check valves configured to allow fluid flow in one direction through the inner bore 16 of the casing shoe 60, and prevent fluid flow in the opposite direction back up through the bore 16 from the casing shoe 60.

The upper check valve assembly 65 comprises a valve member 62, a valve seat 61, a valve guide 69, and a biasing member 82. The biasing member 82 biases the valve member 62 into a closed position where the valve member 62 is in sealing engagement with the valve seat 61. The biasing member 82 is positioned between the valve member 62 and the valve guide 69. A stem portion 63 of the valve member 62 may extend at least partially through the valve guide 69.

The upper check valve assembly 65 also comprises a valve member 66, a valve seat 64, a valve guide 68, and a biasing member 83. The biasing member 83 biases the valve member 66 into a closed position where the valve member 66 is in sealing engagement with the valve seat 64. The biasing member 83 is positioned between the valve member 66 and the valve guide 68. A stem portion 67 of the valve member 66 may extend at least partially through the valve guide 68. The valve guide 69 may abut up against and support an upper end of the valve seat 64.

The lower check valve assembly 90 comprises a valve member 73, a valve seat 72, a valve guide 75, and a biasing member 84. The biasing member 84 biases the valve member 73 into a closed position where the valve member 73 is in sealing engagement with the valve seat 72. The biasing member 84 is positioned between the valve member 73 and the valve guide 75. A stem portion 74 of the valve member 73 may extend at least partially through the valve guide 75.

The lower check valve assembly 90 also comprises a valve member 77, a valve seat 76, a valve guide 79, and a biasing member 85. The biasing member 85 biases the valve member 77 into a closed position where the valve member 77 is in sealing engagement with the valve seat 76. The biasing member 85 is positioned between the valve member 77 and the valve guide 79. A stem portion 78 of the valve member 77 may extend at least partially through the valve guide 79. The valve guide 75 may abut up against and support an upper end of the valve seat 76.

Although only one check valve assembly 65, 90 (and only one valve member 62, 66, 73, 77) is needed to prevent fluid flow back up through the bore 16 of the casing shoe 60, two, three, four, or more check valves and/or valve members may be used as backup valves in the event of failure of the other check valves and/or valve members.

Figure 2:
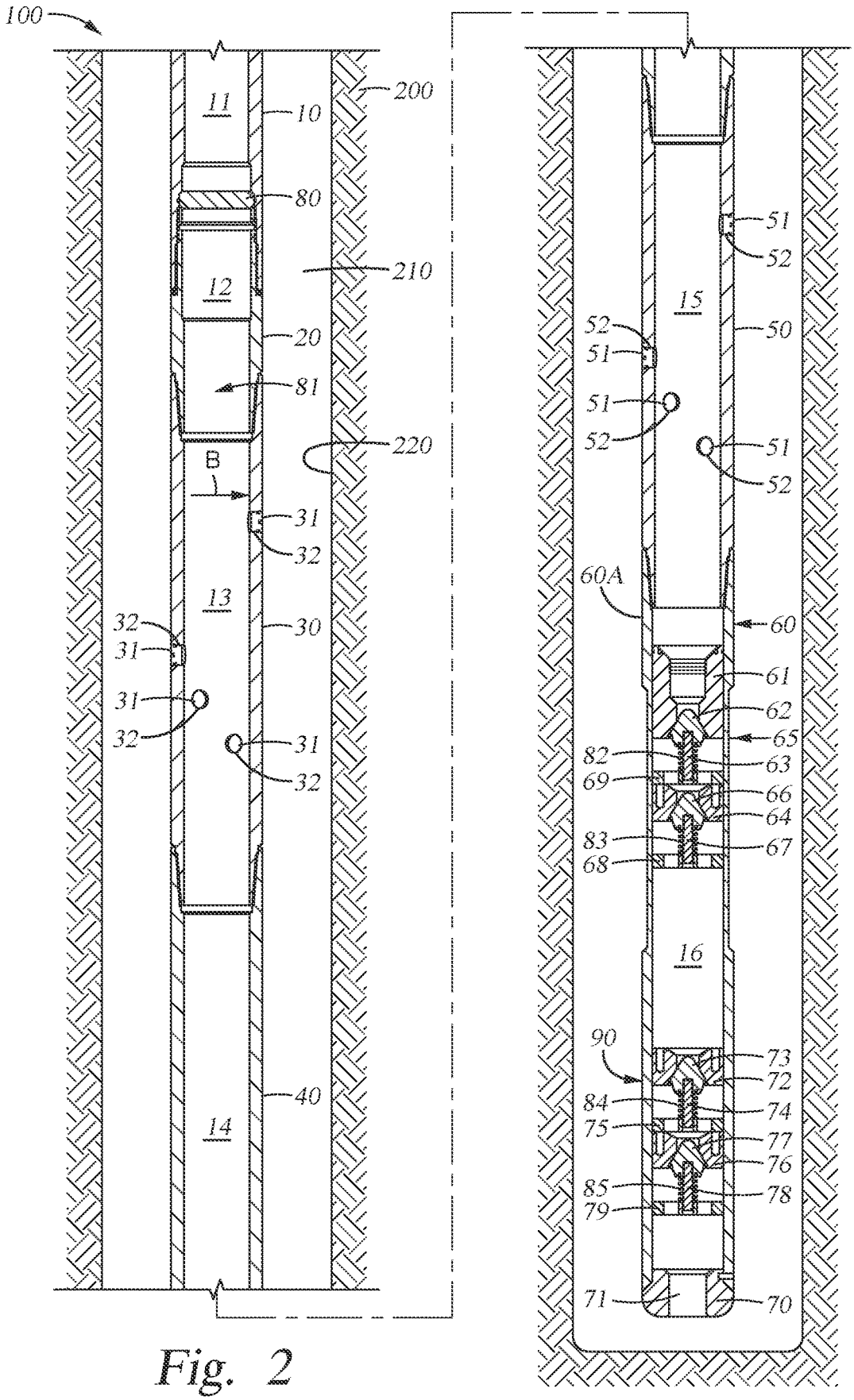
FIG. 2 is a sectional view of the casing string being lowered into a wellbore, according to one embodiment.

FIG. 2 is a sectional view of the casing string 100 being lowered into a wellbore 200, according to one embodiment. The portion of the wellbore 200 illustrated in FIGS. 2, 3, and 4 may be a horizontal wellbore section and/or a wellbore section that is oriented at an angle relative to a vertical axis (e.g. parallel to the force of gravity). An inner area 210 within the wellbore 200 surrounding the casing string 100 is filled with fluid, such as a liquid. The surfaces of the plugs 31, 51 that are exposed to the fluid in the inner area 210 are covered with a coating as illustrated in FIG. 5, and therefore do not begin to dissolve. An atmospheric chamber filled with gas (e.g. air) is formed by the portion of the casing string inner bore 81 between the rupture disk 80 and the upper check valve assembly 65 of the casing shoe 60.

A buoyant force B created between the gas filled casing string 100 and the liquid filled wellbore 200 lifts the casing string 100 or at least helps reduce the weight of the casing string 100 from contact with the surrounding wellbore wall 220 as the casing string 100 is being lowered into the wellbore 200. Specifically, the buoyant force B is created in the chamber formed between the rupture disk 80 and the check valve assembly 65 of the casing shoe. The portion of the casing string 100 above the rupture disk 80 may be filled with a fluid, such as a liquid, to add weight to the casing string to help push the casing string 100 into the wellbore 200. Although the portion of the casing string 100 above the rupture disk 80 may be filled with a fluid, the buoyant force B on the lower end of the casing string 100 helps reduce drag between at least the lower end of the casing string 100 and the surrounding wellbore wall 220, which helps prevent buckling of the casing string 100 and allows the casing string 100 to be lowered into extended horizontal wellbore sections, also referred to as extended reach wellbores.

Figure 3:
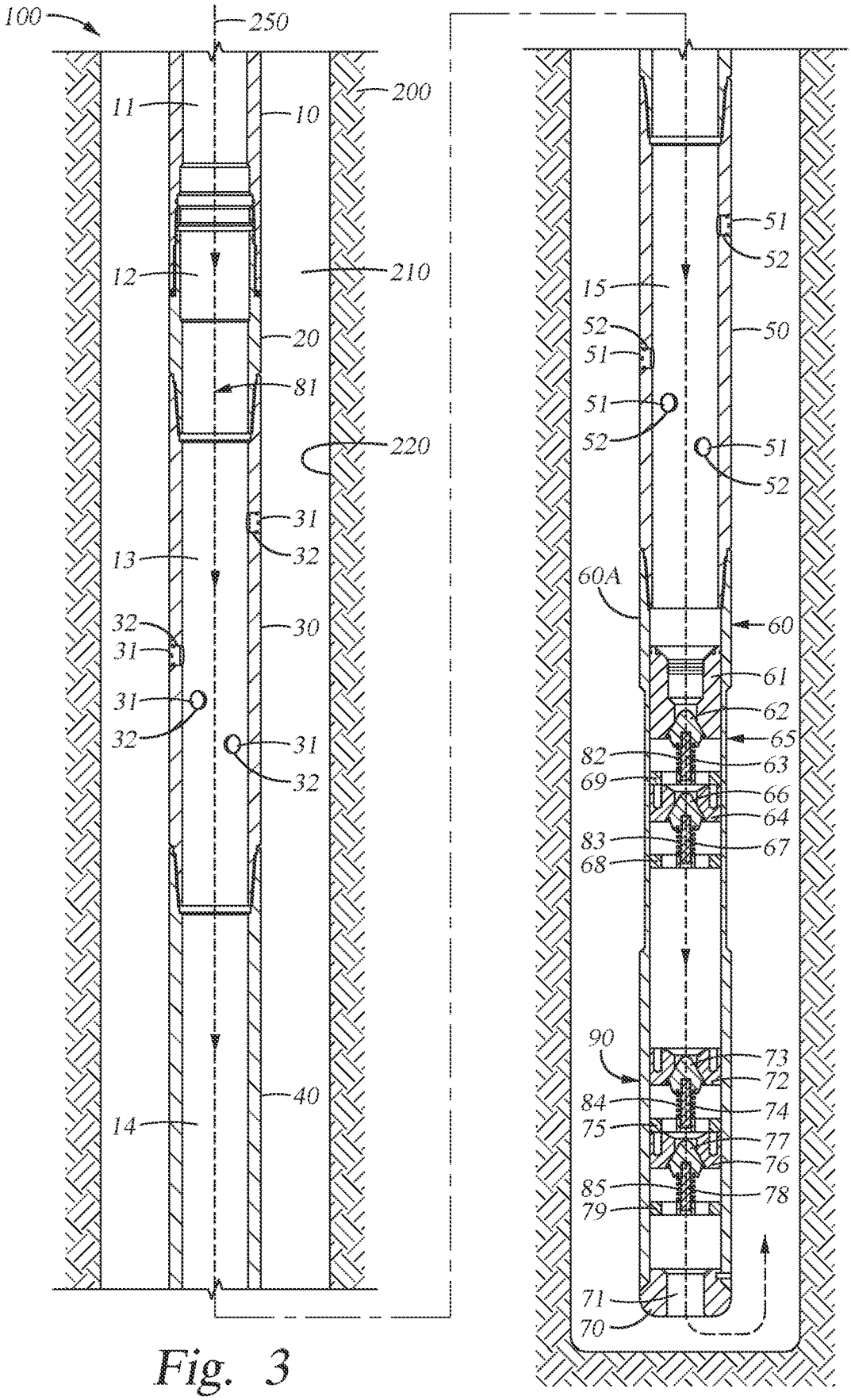
FIG. 3 is a sectional view of a fluid being pumped down through the casing string and into the wellbore, according to one embodiment.

FIG. 3 is a sectional view of a fluid 250, such as a wellbore fluid, being pumped down through the casing string 100 and into the wellbore 200, according to one embodiment. When the casing string 100 is lowered into the desired location with the wellbore 200, pressure within the casing string 100 above the rupture disk 80 can be increased to a pressure sufficient to rupture the rupture disk 80 and allow fluid flow through the casing string inner bore lower end of the casing string 100. The fluid 250 forces the gas that was in the lower end of the casing string 100 to be pumped out through the inner bore 71 of the end cap 70. The fluid 250 is pumped down through the casing string inner bore 81, which flows through the check valve assemblies 65, 90 of the casing shoe 60, and out of the inner bore 71 of the end cap 70 into the inner area 210 of the wellbore 200 surrounding the casing string 100. The fluid 250 can be circulated back to surface through the inner area 210 of the wellbore 200.

The fluid 250 is pumped at a pressure sufficient to move the valve members 62, 66, 73, 77 from the closed positon to the open position against the bias force of the biasing members 82, 83, 84, 85. The check valve assemblies 65, 90 allows the fluid 250 to flow through the casing string inner bore 81 and out of the inner bore 71 of the end cap 70, and prevents the fluid 250 and/or any other fluid in the wellbore 200 from flowing back up through the casing shoe 60. In one embodiment, the fluid 250 can be a fracturing fluid that is pumped down through the casing string 100 and into the inner area 210 of the wellbore 200 to fracture the surrounding wellbore wall 220. In one embodiment, the fluid 250 can be cement that is pumped down through the casing string 100 and into the inner area 210 of the wellbore 200 to cement the casing string 100 in the wellbore 200.

The fluid 250 also contacts the lower (or inner) surfaces, e.g. the uncoated surfaces or portions, of the plugs 31, 51 and begins to dissolve the plugs 31, 51 to open fluid flow through the ports 32, 52. However, additional wellbore operations may be conducted prior to the plugs 31, 51 dissolving to a point where fluid can flow through the ports 32, 52.

Figure 4:
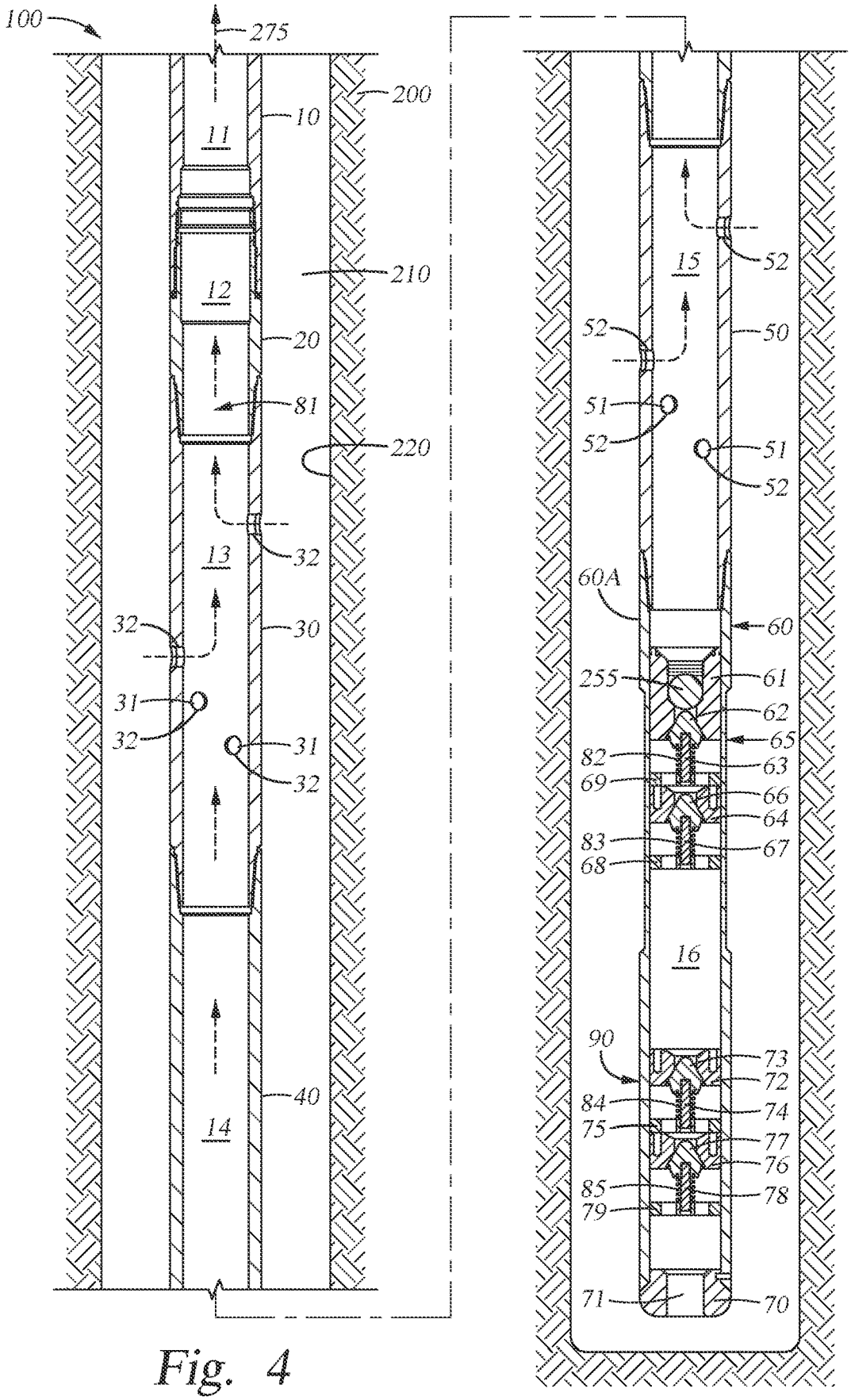
FIG. 4 is a sectional view of a fluid being pumped up through the casing string from the wellbore, according to one embodiment.

FIG. 4 is a sectional view of a fluid 275 being pumped up through the casing string 100 from the wellbore 100, according to one embodiment. A plug 255, such as a cement plug, may be pumped down the casing string 100 and seal on the upper end of the valve seat 61. The plug 255 closes fluid flow down and out through the casing shoe 60. Before the plugs 31, 51 have dissolved, the pressure increase within the casing string 100 may provide an indication that the plug 255 has seated on the valve seat 61.

After a predetermined amount of time, the plugs 31, 51 (illustrated in FIGS. 1-3) may dissolve an amount sufficient to open fluid flow through the ports 32, 52 of the first and second slotted mandrels 30, 50. The fluid 275 from the inner area 210 of the wellbore 200 can flow through the ports 32, 52 into the casing string 100, and be pumped up to the surface through the casing string inner bore 81. The plugs 31, 51 may be configured to dissolve after a predetermined amount of time, such as a predetermined amount of hours, days, or weeks. The predetermined amount of time may be 1-5 hours, days, or weeks; 5-7 hours, days, or weeks; 7-10 hours, days, or weeks; or 10-15 hours, days, or weeks.

The plugs 31, 51 may begin to dissolve after a predetermined amount of time when in contact with wellbore fluids, such as water or oil-based wellbore fluids. The plugs 31, 51 may be formed out of a material that begins to dissolve when in contact with a wellbore fluid. The plugs 31, 51 may be formed out of a dissolvable material comprising magnesium alloys, aluminum alloys, water soluble composites, water soluble plastics, and/or combinations thereof. The use of dissolvable plugs 31, 51 eliminates the need for removing and/or drilling out the plugs 31, 51 after wellbore operations have been completed.

In one embodiment, a casing string, such as the casing string 100, comprises an upper mandrel comprising a rupture disk; a slotted mandrel coupled to a lower end of the upper mandrel and comprising a plug disposed in a port of the slotted mandrel; and a casing shoe coupled to a lower end of the slotted mandrel and comprising a check valve assembly, wherein a gas filled chamber is formed between the rupture disk and the check valve assembly, and wherein the plug is configured to dissolve to allow fluid flow through the port after a predetermined amount of time when in contact with a wellbore fluid.

The rupture disk may be a glass disk. The gas in the gas filled chamber may be air. The plug may comprise a plurality of plugs disposed in a plurality of ports formed through a body of the slotted mandrel. The plug may be formed out of a dissolvable material comprising at least one of magnesium alloys, aluminium alloys, water soluble composites, water soluble plastics, and combinations thereof. A protective coating may be applied to a portion of the plug. The check valve assembly may comprise a pair of check valves configured to allow fluid flow through the casing shoe in one direction and prevent fluid flow in the opposite direction.

In one embodiment, a method of conducting a wellbore operation comprises lowering a casing string, such as casing string 100, into an angled or horizontal section of a wellbore. A gas filled chamber creates a buoyant force on the casing string when lowered into the angled or horizontal section of the wellbore. The method may further comprise rupturing the rupture disk; pumping fluid through the check valve assembly to force the gas out of the casing string, wherein the fluid contacts the plug after rupturing the rupture disk and begins to dissolve the plug; closing fluid flow out through the casing shoe; and when the plug dissolves, pumping fluid from the wellbore back into the casing string through the port. The method may further comprise pumping fluid through the check valve assembly and out of the casing string to facture the wellbore. The method may further comprise pumping fluid through the check valve assembly and out of the casing string to cement the casing string the wellbore. The buoyant force may lift a portion of the casing string or reduce an amount of weight of the casing string that contacts a wall of the wellbore when being lowered into the angled or horizontal section of the wellbore.

In one embodiment, a method of conducting a wellbore operation comprises lowering a casing string, such as casing string 100, into an angled or horizontal section of a wellbore. The casing string may comprise a dissolvable plug, a rupture disk, a check valve assembly, and a gas filled chamber formed between the rupture disk and the check valve assembly. The gas filled chamber may create a buoyant force on the casing string when lowered into the angled or horizontal section of the wellbore. A protective coating may be applied to a portion of the dissolvable plug. The method may further comprise rupturing the rupture disk; pumping fluid through the check valve assembly of the casing string to force gas from the gas filled chamber out of the casing string, wherein the fluid contacts a portion of the dissolvable plug that does not have the protective coating and begins to dissolve the dissolvable plug; and when the dissolvable plug dissolves, pumping fluid from the wellbore back into the casing string through a port that was sealed by the dissolvable plug. The method may further comprise pumping fluid through the check valve assembly and out of the casing string to facture the wellbore. The method may further comprise pumping fluid through the check valve assembly and out of the casing string to cement the casing string the wellbore. The buoyant force may lift a portion of the casing string or reduce an amount of weight of the casing string that contacts a wall of the wellbore when being lowered into the angled or horizontal section of the wellbore. The rupture disk may be a glass disk. The gas in the gas filled chamber may be air. The dissolvable plug may dissolve after a predetermined amount of contact with a wellbore fluid to allow fluid flow through the port.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

The invention claimed is:

1. A casing string, comprising:

an upper mandrel comprising a rupture disk;

a slotted mandrel coupled to a lower end of the upper mandrel and comprising a plug disposed in a port of the slotted mandrel; and a casing shoe coupled to a lower end of the slotted mandrel and comprising a check valve assembly, wherein:

the port of the slotted mandrel is disposed between the rupture disk and the check valve assembly;

a gas filled chamber is formed between the rupture disk and the check valve assembly; and the plug is configured to dissolve to allow fluid flow through the port after a predetermined amount of time when in contact with a wellbore fluid.

2. The casing string of claim 1, wherein the rupture disk is a glass disk.

3. The casing string of claim 1, wherein gas in the gas filled chamber is air.

4. The casing string of claim 1, wherein the plug comprises a plurality of plugs disposed in a plurality of ports formed through a body of the slotted mandrel.

5. The casing string of claim 1, wherein the plug is formed out of a dissolvable material comprising at least one of magnesium alloys, aluminum alloys, water soluble composites, water soluble plastics, and combinations thereof, and wherein a protective coating is applied to a portion of the plug.

6. The casing string of claim 1, wherein the check valve assembly comprises a pair of check valves configured to allow fluid flow through the casing shoe in one direction and prevent fluid flow in the opposite direction.

7. A method of conducting a wellbore operation, comprising:

lowering the casing string of claim 1 into an angled or horizontal section of a wellbore, wherein the gas filled chamber creates a buoyant force on the casing string when lowered into the angled or horizontal section of the wellbore;

rupturing the rupture disk;

pumping fluid through the check valve assembly to force the gas out of the casing string, wherein the fluid contacts the plug after rupturing the rupture disk and begins to dissolve the plug;

closing fluid flow out through the casing shoe; and when the plug dissolves, pumping fluid from the wellbore back into the casing string through the port.

8. The method of claim 7, further comprising pumping fluid through the check valve assembly and out of the casing string to facture the wellbore.

9. The method of claim 7, further comprising pumping fluid through the check valve assembly and out of the casing string to cement the casing string the wellbore.

10. The method of claim 7, wherein the buoyant force lifts a portion of the casing string or reduces an amount of weight of the casing string that contacts a wall of the wellbore when being lowered into the angled or horizontal section of the wellbore.

11. The method of claim 7, wherein the rupture disk is a glass disk.

12. The method of claim 7, wherein gas in the gas filled chamber is air.

13. The method of claim 7, wherein the plug comprises a plurality of plugs disposed in a plurality of ports formed through a body of the slotted mandrel.

14. The method of claim 7, wherein the plug is formed out of a dissolvable material comprising at least one of magnesium alloys, aluminum alloys, water soluble composites, water soluble plastics, and combinations thereof, and wherein a protective coating is applied to a portion of the plug.

15. The method of claim 7, wherein the check valve assembly comprises a pair of check valves configured to allow fluid flow through the casing shoe in one direction and prevent fluid flow in the opposite direction.

16. The method of claim 7, wherein pumping fluid from the wellbore back into the casing string through the port comprises pumping fluid from an annulus, formed between the casing string and the wellbore, through the port into an inner bore of the casing string above the check valve assembly and up to a top surface of the wellbore.

17. A method of conducting a wellbore operation, comprising:

lowering a casing string into an angled or horizontal section of a wellbore, wherein the casing string comprises a dissolvable plug, a rupture disk, a check valve assembly, and a gas filled chamber formed between the rupture disk and the check valve assembly, wherein the gas filled chamber creates a buoyant force on the casing string when lowered into the angled or horizontal section of the wellbore, and wherein a protective coating is applied to a portion of the dissolvable plug;

rupturing the rupture disk;

pumping fluid through the check valve assembly of the casing string to force gas from the gas filled chamber out of the casing string, wherein the fluid contacts a portion of the dissolvable plug that does not have the protective coating and begins to dissolve the dissolvable plug; and when the dissolvable plug dissolves, pumping fluid from the wellbore back into the casing string through a port that was sealed by the dissolvable plug.

18. The method of claim 17, further comprising pumping fluid through the check valve assembly and out of the casing string to facture the wellbore.

19. The method of claim 17, further comprising pumping fluid through the check valve assembly and out of the casing string to cement the casing string the wellbore.

20. The method of claim 17, wherein the buoyant force lifts a portion of the casing string or reduces an amount of weight of the casing string that contacts a wall of the wellbore when being lowered into the angled or horizontal section of the wellbore.

21. The method of claim 17, wherein the rupture disk is a glass disk, wherein gas in the gas filled chamber is air, and wherein the dissolvable plug dissolves after a predetermined amount of contact with a wellbore fluid to allow fluid flow through the port.

22. The method of claim 17, wherein pumping fluid from the wellbore back into the casing string through the port comprises pumping fluid from an annulus, formed between the casing string and the wellbore, through the port into an inner bore of the casing string above the check valve assembly and up to a top surface of the wellbore.

* * * * *